US006588203B2

(12) United States Patent
Hirota et al.

(10) Patent No.: US 6,588,203 B2
(45) Date of Patent: Jul. 8, 2003

(54) EXHAUST DEVICE OF INTERNAL COMBUSTION ENGINE

(75) Inventors: Shinya Hirota, Susono (JP); Masahito Shibata, Mishima (JP); Michio Morishita, Toyota (JP); Takio Suzuki, Kariya (JP); Shigeru Arakawa, Obu (JP); Kunio Komori, Okazaki (JP)

(73) Assignees: Toyota Jidosha Kabushiki Kaisha, Toyota (JP); Sango Co., Ltd., Nagoya (JP); Futaba Sangyo Kabushiki Kaisha, Okazaki (JP)

( * ) Notice: Subject to any disclaimer, the term of this patent is extended or adjusted under 35 U.S.C. 154(b) by 18 days.

(21) Appl. No.: 09/893,538

(22) Filed: Jun. 29, 2001

(65) Prior Publication Data

US 2002/0002824 A1 Jan. 10, 2002

(30) Foreign Application Priority Data

Jul. 3, 2000 (JP) ..... 2000-205583

(51) Int. Cl.[7] ..... F01N 3/00

(52) U.S. Cl. ..... 60/297; 60/288; 60/296; 181/238; 181/258

(58) Field of Search ..... 60/288, 287, 296, 60/297, 323; 181/238, 256, 258, 265, 272

(56) References Cited

U.S. PATENT DOCUMENTS

| | | | | | |
|---|---|---|---|---|---|
| 4,074,975 | A | * | 2/1978 | Tokura et al. | 60/297 |
| 4,645,521 | A | * | 2/1987 | Freesh | 181/265 |
| 4,902,487 | A | | 2/1990 | Cooper et al. | |
| 4,913,260 | A | * | 4/1990 | Fallon | 181/272 |
| 4,916,897 | A | | 4/1990 | Hayashi et al. | 60/296 |
| 5,063,736 | A | | 11/1991 | Hough et al. | |
| 5,100,632 | A | | 3/1992 | Dettling et al. | |
| 5,293,742 | A | | 3/1994 | Gillingham et al. | |
| 5,519,994 | A | * | 5/1996 | Hill | 181/238 |
| 5,768,888 | A | * | 6/1998 | Matros et al. | 60/296 |
| 6,148,613 | A | * | 11/2000 | Klopp et al. | 60/296 |
| 6,314,722 | B1 | * | 11/2001 | Matros et al. | 60/296 |

FOREIGN PATENT DOCUMENTS

| | | |
|---|---|---|
| DE | 92 17 940 | 3/1993 |
| EP | 0 556 846 A1 | 8/1993 |
| EP | 0 766 993 A2 | 4/1997 |
| JP | 1-149515 U | 10/1989 |
| JP | A 6-159037 | 6/1994 |
| JP | A 6-272541 | 9/1994 |
| JP | B2 7-106290 | 11/1995 |
| JP | A 9-94434 | 4/1997 |
| JP | A 11-300165 | 11/1999 |
| JP | B2 3012249 | 12/1999 |
| JP | A 2000-18026 | 1/2000 |

* cited by examiner

*Primary Examiner*—Thomas Denion
*Assistant Examiner*—Tu M. Nguyen
(74) *Attorney, Agent, or Firm*—Oliff & Berridge, PLC

(57) ABSTRACT

An engine including a silencer in the exhaust passage thereof, wherein an exhaust gas flow passage pipe is arranged in the silencer body and a particulate filter is arranged inside the exhaust gas flow passage pipe. A first exhaust gas inflow-outflow opening and a second exhaust gas inflow-outflow opening of the exhaust gas passage pipe and an exhaust gas inflow opening to the silencer body are arranged at one end of the silencer body. The exhaust gas is selectively supplied to the first exhaust gas inflow-outflow opening, second exhaust gas inflow-outflow opening, and exhaust gas inflowing opening.

13 Claims, 11 Drawing Sheets

EXHAUST DEVICE OF INTERNAL COMBUSTION ENGINE

BACKGROUND OF THE INVENTION

1. Field of the Invention

The present invention relates to an exhaust device of an internal combustion engine.

2. Description of the Related Art

In the related art, in a diesel engine, particulate contained in the exhaust gas is removed by arranging a particulate filter in the engine exhaust passage, using that particulate filter to trap the particulate in the exhaust gas, and igniting and burning the particulate trapped on the particulate filter to regenerate the particulate filter. The particulate trapped on the particulate filter, however, does not ignite unless the temperature becomes a high one of at least about 600° C. As opposed to this, the temperature of the exhaust gas of a diesel engine is normally considerably lower than 600° C. Therefore, normally an electric heater is used to heat the exhaust gas to ignite and burn the particulate trapped on the particulate filter.

Further, when burning particulate trapped on the particulate filter, if the flow rate of the exhaust gas passing through the particulate filter is too fast, the particulate will not continue to be burned. To make it continue to burn, it is necessary to slow the flow rate of the exhaust gas passing through the particulate filter. Further, to make the exhaust system of the engine more compact, it is preferable to arrange a particulate filter and electric heater in the silencer.

Therefore, known in the art has been an exhaust device providing a particulate filter and electric heater in a silencer, providing a flow path switching valve for switching the flow path of the exhaust gas, using the flow rate switching valve to normally cause the exhaust gas to flow into the particulate filter, heating part of the exhaust gas by the electric heater when igniting and burning the particulate trapped on the particulate filter, then causing the exhaust gas to flow in the opposite direction to the time of normal operation in the particulate filter so as to cause the exhaust gas to be exhausted into the atmosphere without allowing the remaining large part of the exhaust gas to flow into the particulate filter (Japanese Unexamined Utility Model Publication (Kokai) No. 1-149515).

On the other hand, the particulate trapped on the particulate filter is preferably ignited and burned by the heat of the exhaust gas without using an electric heater. Therefore, it has been necessary to reduce the ignition temperature of the particulate. It has been known in the related art, however, that the ignition temperature of particulate can be reduced if carrying a catalyst on the particulate filter. Therefore, known in the art are various particulate filters carrying catalysts for reducing the ignition temperature of the particulate.

For example, Japanese Examined Patent Publication (Kokoku) No. 7-106290 discloses a particulate filter comprising a particulate filter carrying a mixture of a platinum group metal and an alkali earth metal oxide. In this particulate filter, the particulate is ignited by a relatively low temperature of about 350° C. to 400° C., then is continuously burned.

Summarizing the problem to be solved by the invention, in a diesel engine, when the load becomes high, the temperature of the exhaust gas reaches from 350° C. to 400° C., therefore with the above particulate filter, it would appear at first glance that the particulate could be made to ignite and burn by the heat of the exhaust gas when the engine load becomes high. In fact, however, once a large amount of particulate ends up depositing on the particulate filter, the particulate gradually changes to hard-to-burn carbon. As a result, even if the temperature of the exhaust gas reaches from 350° C. to 400° C., sometimes the particulate will not ignite. Therefore, in order to cause the particulate on the particulate filter to continuously burn, it is necessary to prevent a large amount of particulate from depositing on the particulate filter.

SUMMARY OF THE INVENTION

An object of the present invention is to provide a compact, practical exhaust device of an internal combustion engine suitable for continuously oxidizing and removing the particulate on the particulate filter.

According to the present invention, there is provided an exhaust gas purification apparatus of an internal combustion engine comprising a silencer body having an end portion and an exhaust gas inflow opening through which an exhaust gas is introduced into an interior of the silencer body; an exhaust gas flow passage having opposing ends and a passage portion extending within the interior of the silencer body, a first exhaust gas inflow-outflow opening being formed at one of the opposing ends of the exhaust gas flow passage, a second exhaust gas inflow-outflow opening being formed at the other of the opposing ends of the exhaust gas flow passage, all of the exhaust gas inflow opening, the first exhaust gas inflow-outflow opening, and the second exhaust gas inflow-outflow opening being arranged in the end portion of the silencer body; a particulate filter arranged in the passage portion of the exhaust gas flow passage; and a flow path switching valve device arranged in the end portion of the silencer body for causing an exhaust gas, discharged from the engine and directed to the silencer body, to selectively flow into at least one of the exhaust gas inflow opening, the first exhaust gas inflow-outflow opening, and the second exhaust gas inflow-outflow opening.

BRIEF DESCRIPTION OF THE DRAWINGS

These and other objects and features of the present invention will be more apparent from the following description given with reference to the accompanying drawings, wherein.

DESCRIPTION OF THE PREFERRED EMBODIMENTS

Figure 1:
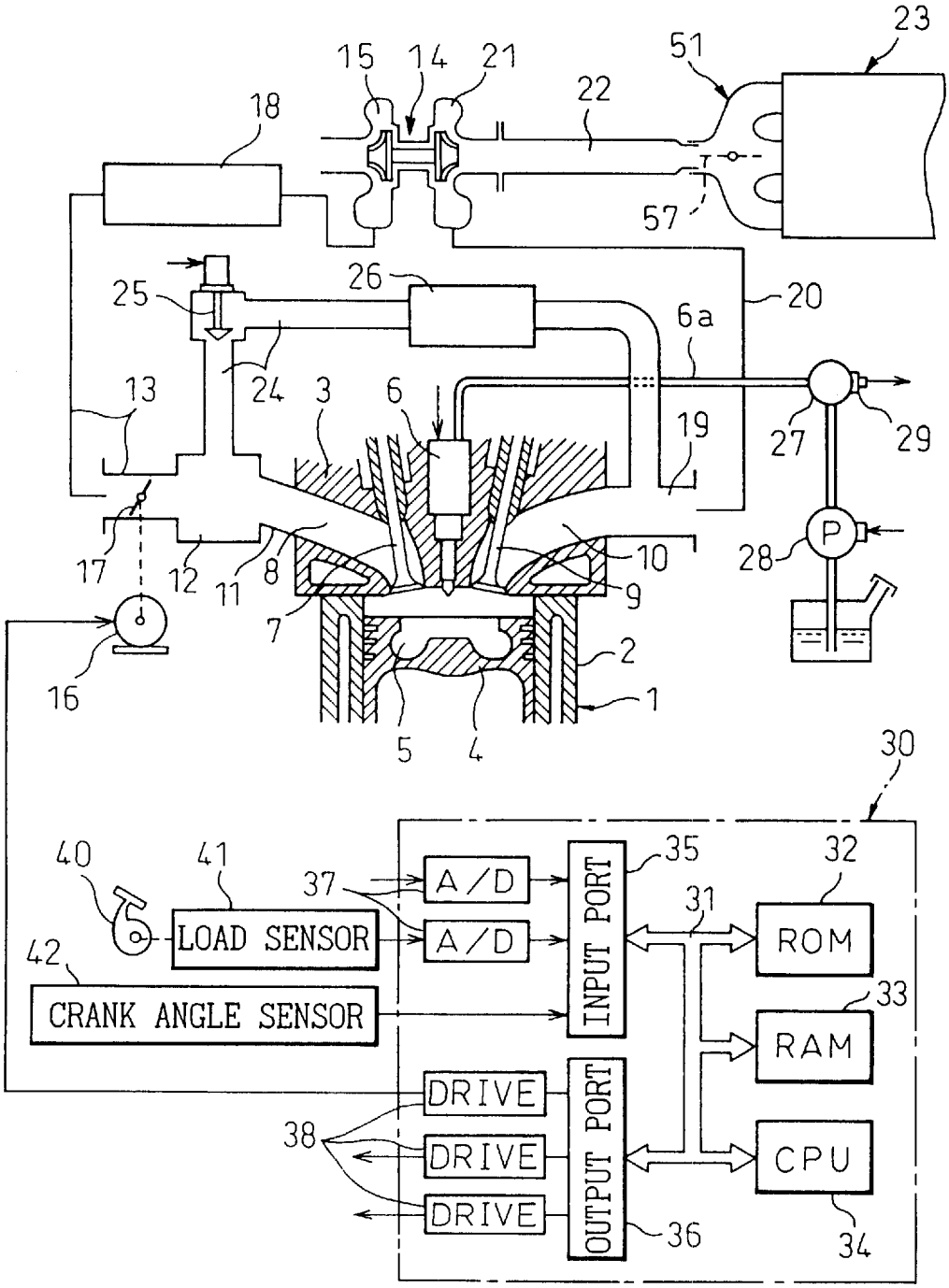
FIG. 1 is an overall view of an internal combustion engine.

FIG. 1 shows the case of application of the present invention to a compression ignition type internal combustion engine. Note that the present invention can also be applied to a spark ignition type internal combustion engine.

Referring to FIG. 1, 1 indicates an engine body, 2 a cylinder block, 3 a cylinder head, 4 a piston, 5 a combustion chamber, 6 an electrically controlled fuel injector, 7 an intake valve, 8 an intake port, 9 an exhaust valve, and 10 an exhaust port. The intake port 8 is connected to a surge tank 12 through a corresponding intake tube 11, while the surge tank 12 is connected to a compressor 15 of an exhaust turbocharger 14 through an intake duct 13. Inside the intake duct 13 is arranged a throttle valve 17 driven by a step motor 16. Further, a cooling device 18 is arranged around the intake duct 13 for cooling the intake air flowing through the intake duct 13. In the embodiment shown in FIG. 1, the engine coolant water is led inside the cooling device 18 and the intake air is cooled by the engine coolant water. On the other hand, the exhaust port 10 is connected to an exhaust turbine 21 of an exhaust turbocharger 14 through an exhaust manifold 19 and an exhaust pipe 20. The outlet of the exhaust turbine 21 is connected to a silencer 23 through an exhaust pipe 22.

The exhaust manifold 19 and the surge tank 12 are connected to each other through an exhaust gas recirculation (EGR) passage 24. Inside the EGR passage 24 is arranged an electrically controlled EGR control valve 25. A cooling device 26 is arranged around the EGR passage 24 to cool the EGR gas circulating inside the EGR passage 24. In the embodiment shown in FIG. 1, the engine coolant water is guided inside the cooling device 26 and the EGR gas is cooled by the engine coolant water. On the other hand, fuel injectors 6 are connected to a fuel reservoir, a so-called common rail 27, through fuel feed pipes 6*a*. Fuel is fed into the common rail 27 from an electrically controlled variable discharge fuel pump 28. The fuel fed into the common rail 27 is fed to the fuel injectors 6 through the fuel feed pipes 6*a*. The common rail 27 has a fuel pressure sensor 29 attached to it for detecting the fuel pressure in the common rail 27. The discharge of the fuel pump 28 is controlled based on the output signal of the fuel pressure sensor 29 so that the fuel pressure in the common rail 27 becomes a target fuel pressure.

An electronic control unit 30 is comprised of a digital computer provided with a read only memory (ROM) 32, random access memory (RAM) 33, microprocessor (CPU) 34, input port 35, and output port 36 connected to each other through a bidirectional bus 31. The output signal of the fuel pressure sensor 29 is input through a corresponding AD converter 37 to the input port 35. An accelerator pedal 40 has connected to it a load sensor 41 generating an output voltage proportional to the amount of depression L of the accelerator pedal 40. The output voltage of the load sensor 41 is input to the input port 35 through the corresponding AD converter 37. Further, the input port 35 has connected to it a crank angle sensor 42 generating an output pulse each time a crankshaft rotates by for example 30 degrees. On the other hand, the output port 36 is connected through corresponding drive circuits 38 to the fuel injectors 6, the step motor 16 for driving the throttle valve, the EGR control valve 25, and the fuel pump 28.

Figure 2A:
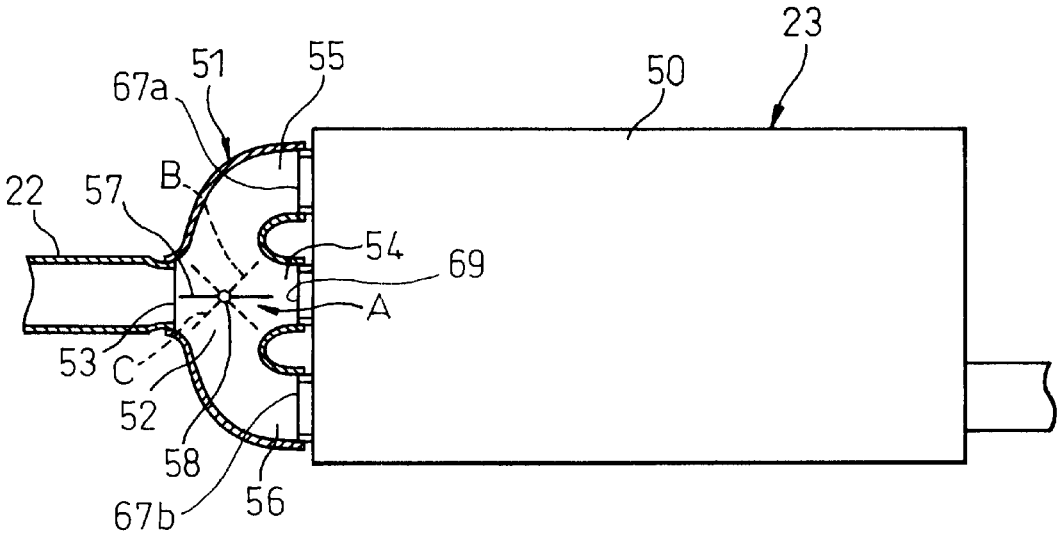
FIGS. 2A and 2B are views of a silencer.
Figure 2B:
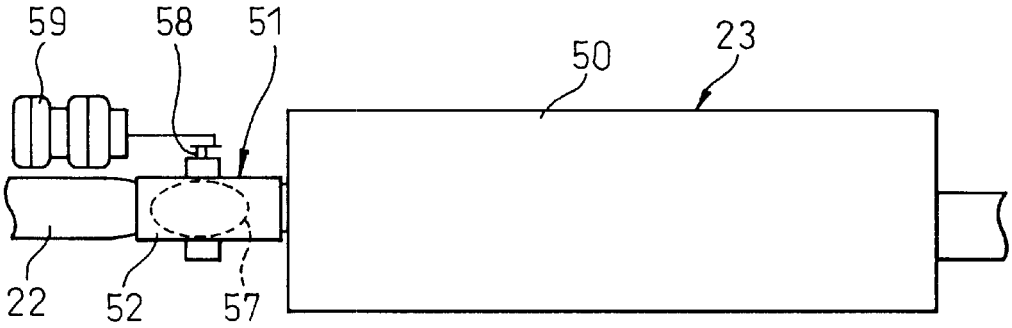

FIG. 2A is a plan view of a silencer 23 shown in FIG. 1, while FIG. 2B is a side view of the silencer 23 shown in FIG. 1. As shown in FIG. 2A and FIG. 2B, the silencer 23 is comprised of a silencer body 50 and a flow path switching valve device 51 arranged between the exhaust pipe 22 and the silencer body 50. The flow path switching valve device 51 is comprised of a manifold comprised of a collecting portion 52, an exhaust gas intake opening 53 connected to the outlet of the exhaust pipe 22 for the intake of exhaust gas exhausted from the engine, and three tubes branched from the collecting portion, that is, a first tube 54, a second tube 55, and a third tube 56.

As shown in FIGS. 2A and 2B, a flow path switching valve 57 of the form of a butterfly valve is arranged in the collecting portion 52 of the manifold. The valve shaft 58 of the flow path switching valve 57 is connected to an actuator 59 comprised of for example a vacuum actuated diaphragm device. In the embodiment shown in FIGS. 2A and 2B, the flow path switching valve 57 is controlled by the actuator 59 to one position among a first position shown by the solid line A in FIG. 2A, a second position shown by the broken line B, and a third position shown by the broken line C.

Figure 3A:
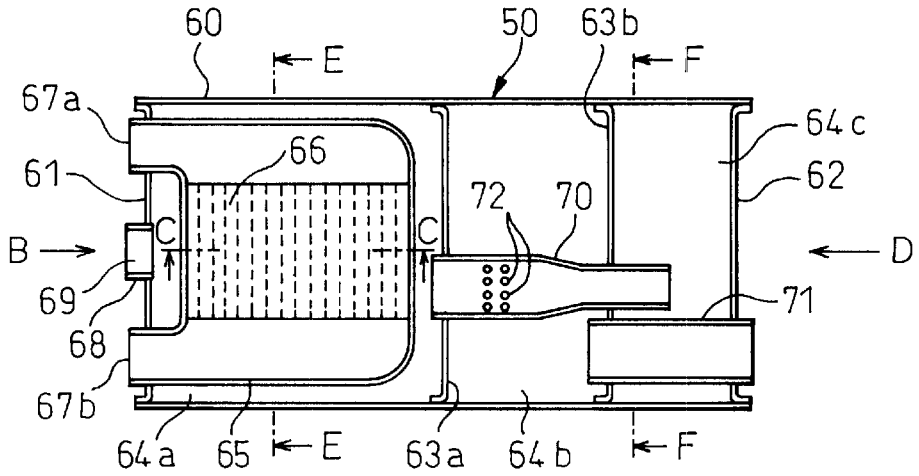
FIGS. 3A to 3F are views of a first embodiment of a silencer body.
Figure 3B:
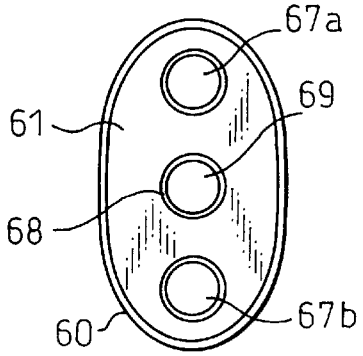
Figure 3C:
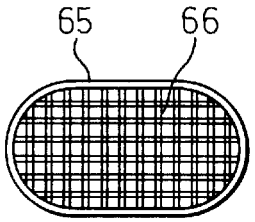
Figure 3D:
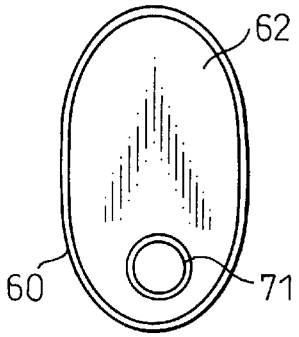
Figure 3E:
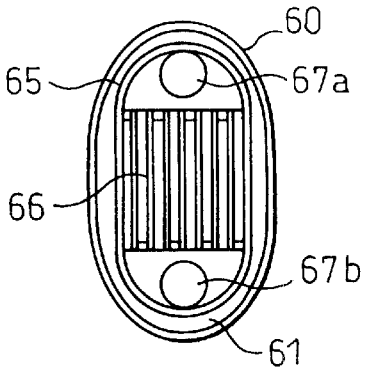
Figure 3F:
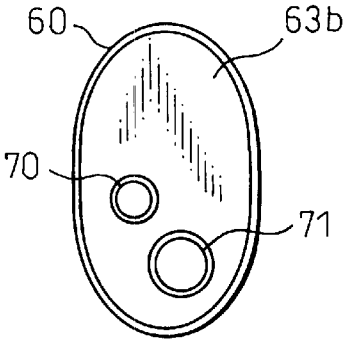

FIGS. 3A to 3F show a first embodiment of the silencer body 50 shown in FIGS. 2A and 2B. Note that FIG. 3A is a sectional plan view of the silencer body 50, FIGS. 3B and 3D are side views seen along the arrows B and D in FIG. 3A, and FIGS. 3C, 3E, and 3F are sectional views seen along C—C, E—E, and F—F in FIG. 3A.

The silencer body 50 is provided with an outer peripheral wall 60 having an elliptical sectional shape, an end wall 61 covering one end of the silencer body 50, and an end wall 62 covering the other end of the silencer body 50. In the silencer body 50 are formed a plurality of partition walls parallel with these end walls 61 and 62, a plurality of subchambers divided by two partition walls 63*a* and 63*b* in the first embodiment shown in FIG. 3, and three subchambers 64*a*, 64*b*, and 64*c* in the first embodiment shown in FIG. 3. These subchambers 64*a*, 64*b*, and 64*c* form either expansion chambers for attenuating the pressure pulsation of the inflowing exhaust gas to reduce the exhaust noise or resonance chambers for forming Helmholtz resonators to reduce the exhaust noise of a specific frequency. In the first embodiment shown in FIG. 3, the subchamber 64*a* forms a first expansion chamber, the subchamber 64*b* forms a second expansion chamber, and a subchamber 64*c* forms a resonance chamber.

In the first embodiment shown in FIG. 3, an exhaust gas passage pipe 65 extended forming a U-shape is arranged in the first expansion chamber 64*a* formed at one end of the silencer body 50, that is, between the end wall 61 and partition wall 63*a*, while a particulate filter 66 is arranged at the center of the exhaust gas passage pipe 65. One end of the exhaust gas passage pipe 65 projects out slightly from the end wall 61. A first exhaust gas outflow-inflow opening 67*a* is formed at the projecting part. On the other hand, the other end of the exhaust gas passage pipe 65 also projects out slightly from the end wall 61. A second exhaust gas outflow-inflow opening 67*b* is formed at that projecting part. As will be understood from FIGS. 3A and 3E, the outer peripheral wall of the exhaust gas passage pipe 65 is arranged a distance away from the inner wall surface of the outer peripheral wall 60 of the silencer body 50 across its entirety.

On the other hand, as will be shown in FIGS. 3A and 3B, a pipe 68 with a length shorter than its diameter is arranged on the end wall 61 between the first exhaust gas outflow-inflow opening 67*a* and the second exhaust gas outflow-inflow opening 67*b*. The exhaust gas inflow opening 69 communicating with the first expansion chamber 64*a* is formed in the pipe 68. The first tube 54, second tube 55, and third tube 56 of the manifold shown in FIG. 3A are connected by for example welding to the exhaust gas inflow opening 69, first exhaust gas outflow-inflow opening 67*a*, and second exhaust gas outflow-inflow opening 67*b* shown in FIG. 3A.

On the other hand, inside the silencer body 50 are arranged a communication pipe 70 extending from inside the first expansion chamber 64*a* to inside the resonance chamber 64*c* and an exhaust pipe 71 communicating with the second expansion chamber 64*b* for exhausting the exhaust gas fed into the silencer body 50 to the outside from the silencer body 50. As shown in FIG. 3A, a large number of exhaust gas outflow ports 72 opening inside the second expansion chamber 64*b* are formed in the peripheral wall surface of the communicating pipe 70.

Figure 4A:
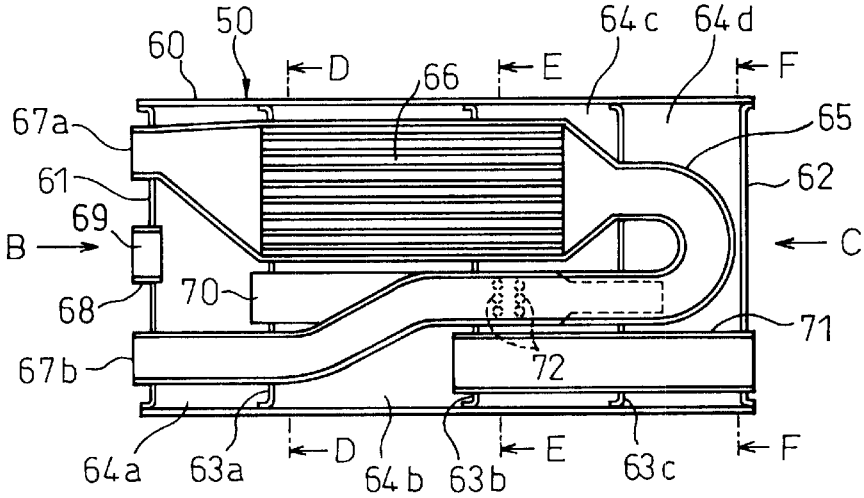
FIGS. 4A to 4F are views of a second embodiment of a silencer body.
Figure 4B:
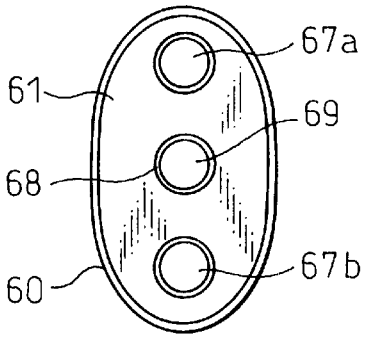
Figure 4C:
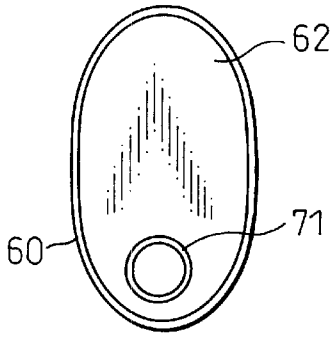
Figure 4D:
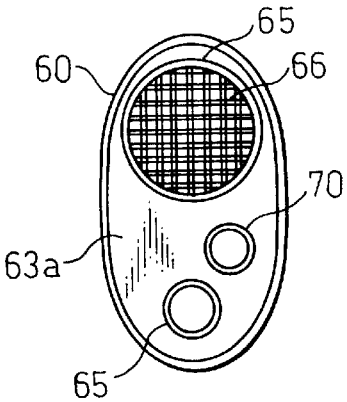

Next, an explanation will be given of a second embodiment of the silencer body 50 with reference to FIGS. 4A to 4F. Note that FIG. 4A is a sectional view of the silencer body 50, FIGS. 4B and 4C are side views along the arrows B and C in FIG. 4A, and FIGS. 4D, 4E, and 4F are sectional views along D—D, E—E, and F—F in FIG. 4A. Further, constituent elements similar to the constituent elements shown in FIGS. 3A to 3F are shown by the same reference numerals and explanations of these similar constituent elements are omitted. Referring to FIGS. 4A to 4F, in the second embodiment, the inside of the silencer body 50 is divided into four subchambers 64*a*, 64*b*, 64*c*, and 64*d* by the three partition walls 63*a*, 63*b*, and 63*c*. The subchamber 64*a* forms a first expansion chamber, the subchamber 64*c* a second expansion chamber, the subchamber 64*b* a third expansion chamber, and the third subchamber 64*d* a resonance chamber.

Figure 4E:
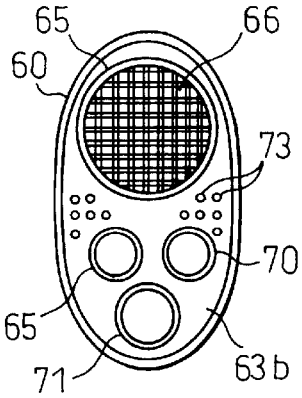
Figure 4F:
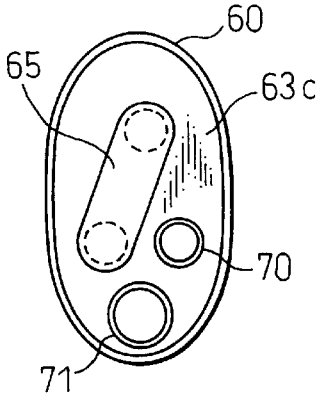

The exhaust gas passage pipe 65 extends from the first expansion chamber 64*a* through the third expansion chamber 64*b* and second expansion chamber 64*c* to the inside of the resonance chamber 64*d*. The outer peripheral surface of the exhaust gas passage pipe 65 is also arranged at a distance from the inside wall surface of the outer peripheral wall 60 of the silencer body 50 across its entirety. On the other hand, as will be understood from FIGS. 4A, 4D, 4E, and 4F, the communicating pipe 70 extends in FIG. 4A below the exhaust gas passage pipe 65 from the first expansion chamber 64*a* to the resonance chamber 64*d*. On the inner wall surface of the communicating pipe 70 is formed, in the same way as the first embodiment, a large number of exhaust gas outflow holes 72 opening inside the second expansion chamber 64*c*. Further, in the second embodiment, a large number of exhaust gas outflow holes 73 communicating the second expansion chamber 64*c* and third expansion chamber 64*b* are formed on the partition wall 63*b* as shown in FIG. 4E. Further, in the second embodiment, the exhaust pipe 71 opens in the third expansion chamber 64*b*.

Figure 5A:
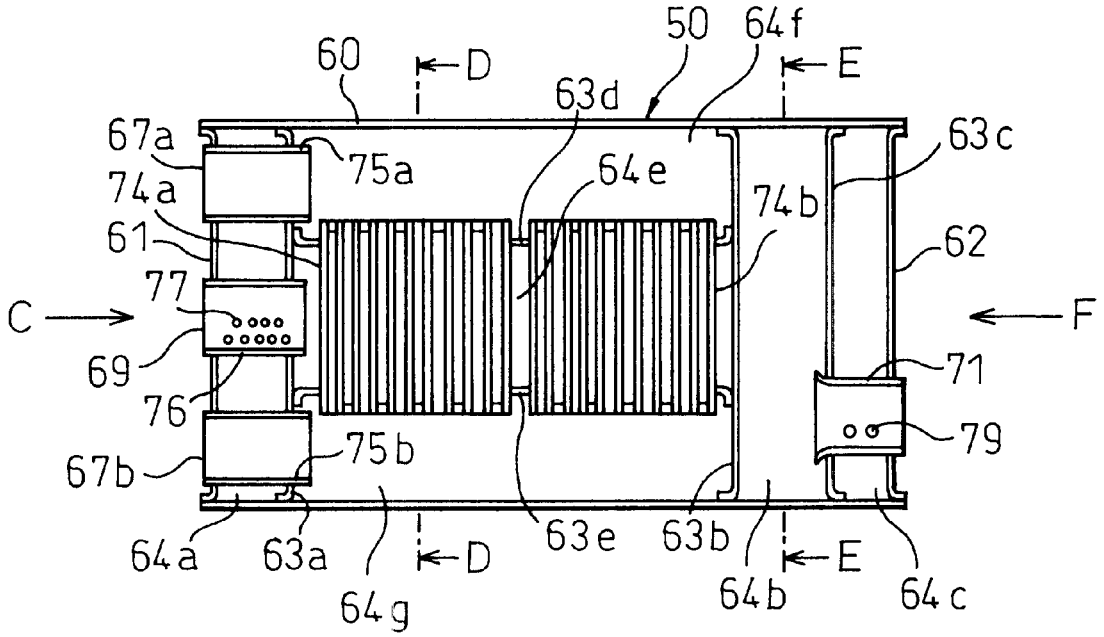
FIGS. 5A to 5F are views of a third embodiment of a silencer body.
Figure 5B:
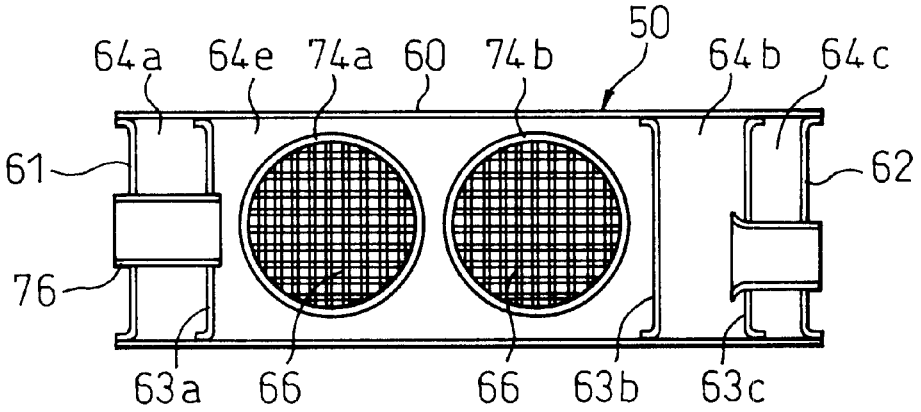
Figure 5C:
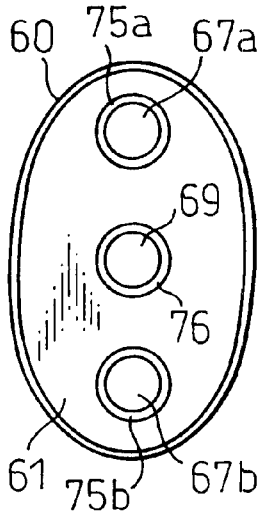
Figure 5D:
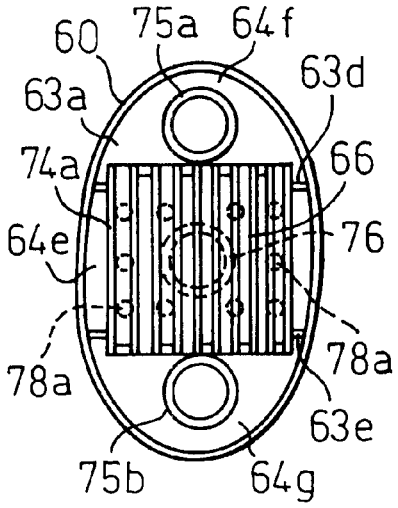
Figure 5E:
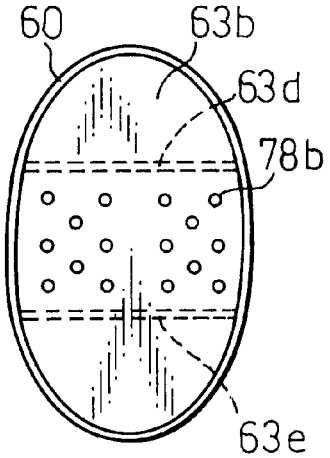
Figure 5F:
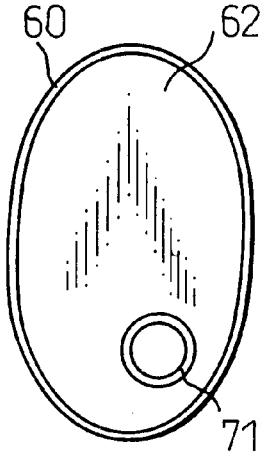

Next, an explanation will be given of a third embodiment of the silencer body 50 while referring to FIGS. 5A to 5F. Note that FIG. 5A is a sectional plan view of the silencer body 50, FIG. 5B is a side sectional view of the silencer body 50, FIGS. 5C and 5F are side views along the arrows C and F in FIG. 5A, and FIGS. 5D and 5E are sectional views along D—D and E—E in FIG. 5A. Further, constituent elements in FIGS. 5A to 5F similar to the constituent elements shown in FIGS. 3A to 3F are shown by the same reference numerals and explanations of these similar constituent elements are omitted.

Referring to FIGS. 5A to 5F, in the third embodiment, the inside of the silencer body 50 is formed with three partition walls 63*a*, 63*b*, and 63*c* in parallel with the end walls 61 and 62. Further, in the third embodiment, it is formed with two partition walls 63*d* and 63*e* extending in parallel from the partition wall 63*a* to the partition wall 63*b*. That is, in the third embodiment, the inside of the silencer body 50 is formed with five partition walls 63*a*, 63*b*, 63*c*, 63*d*, and 63*e*. The inside of the silencer body 50 is divided into six subchambers 64*a*, 64*b*, 64*c*, 64*d*, 64*e*, 64*f*, and 64*g* by the five partition walls 63*a*, 63*b*, 63*c*, 63*d*, and 63*e*.

As shown in FIG. 5A, inside the silencer body 50 are arranged a pair of cylindrical members 74*a* and 74*b* communicating the subchamber 64*f* and subchamber 64*g* through the pair of partition walls 63*d* and 63*e*. In these cylindrical members 74*a* and 74*b* are arranged particulate filters 66. Further, inside the silencer body 50 are arranged three pipes 75*a*, 75*b*, and 76 extending through the end wall 61 and the partition wall 63*a*. A first exhaust gas outflow-inflow opening 67*a* is formed at the outside end of the pipe 75*a*. The inside end of the pipe 75*a* opens inside the subchamber 64*f*. On the other hand, a second exhaust gas outflow-inflow opening 67*a* is formed at the outside end of the pipe 75*b*. The inside end of the pipe 75*b* opens in the subchamber 64*g*. Therefore, the first exhaust gas outflow-inflow opening 67*a* and the second exhaust gas outflow-inflow opening 67*b* are communicated through the subchambers 64*f* and 64*g* and the particulate filters 66. In the third embodiment, the subchambers 64*f* and 64*g* form an exhaust gas passage pipe passing through the first exhaust gas outflow-inflow opening 67*a* and the second exhaust gas outflow-inflow opening 67*b*.

On the other hand, an exhaust gas inflow opening 69 is formed at the outside end of the pipe 76. The inside end of the pipe 76 opens inside the subchamber 64*e*. In the inner wall surface of the pipe 76 are formed a large number of communicating holes 77 opening inside the subchamber 64*a* as shown in FIG. 5A. Further, the partition wall 63*a* is formed with a large number of exhaust gas outflow holes 78*a* communicating the subchamber 64*a* and the subchamber 64*e* as shown by the broken line in FIG. 5D. Similarly, the partition wall 63*b* is formed with a large number of exhaust gas outflow holes 78*b* communicating the subchamber 64*e* and the subchamber 64*b* as shown by the broken line in FIG. 5E. Further, the exhaust pipe 71 communicates with the subchamber 64*b*. A communicating hole 79 opening in the subchamber 64*c* is formed in the inner wall surface of the exhaust pipe 71 as shown in FIG. 5A. Note that the communicating hole 79 does not necessarily have to be provided.

In the third embodiment, the subchamber 64*a* forms a resonance chamber, the subchamber 64*e* forms a first expansion chamber, and the subchamber 64*b* forms a second expansion chamber. Further, as shown in FIG. 5A, when forming a communicating hole 79 in the inner wall surface of the exhaust pipe 71, the subchamber 64*c* forms a resonance chamber. Therefore, the first expansion chamber 64*e* is formed around the cylindrical members 74*a* and 74*b* supporting the particulate filters 66. These cylindrical members 74*a* and 74*b*, that is, the exhaust gas passage portions where the particulate filters 66 are arranged, are arranged at a distance from the inside wall surface of the silencer body 50. Note that in the third embodiment as well, the first tube 54, second tube 55, and third tube 56 of the manifold shown in FIG. 2A are connected by for example welding to the exhaust gas inflow opening 69, the first exhaust gas outflow-inflow opening 67*a*, and the second exhaust gas outflow-inflow opening 67*b* shown in FIG. 5A.

Figure 6A:
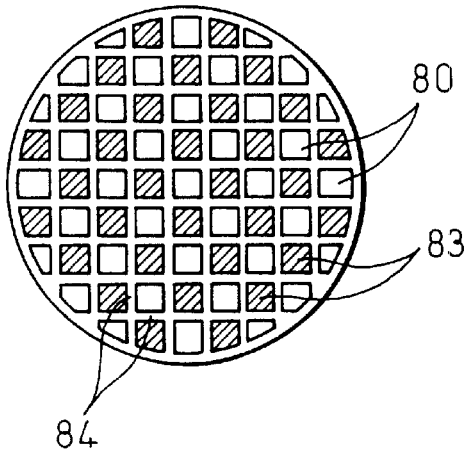
FIGS. 6A and 6B are views of a particulate filter.
Figure 6B:
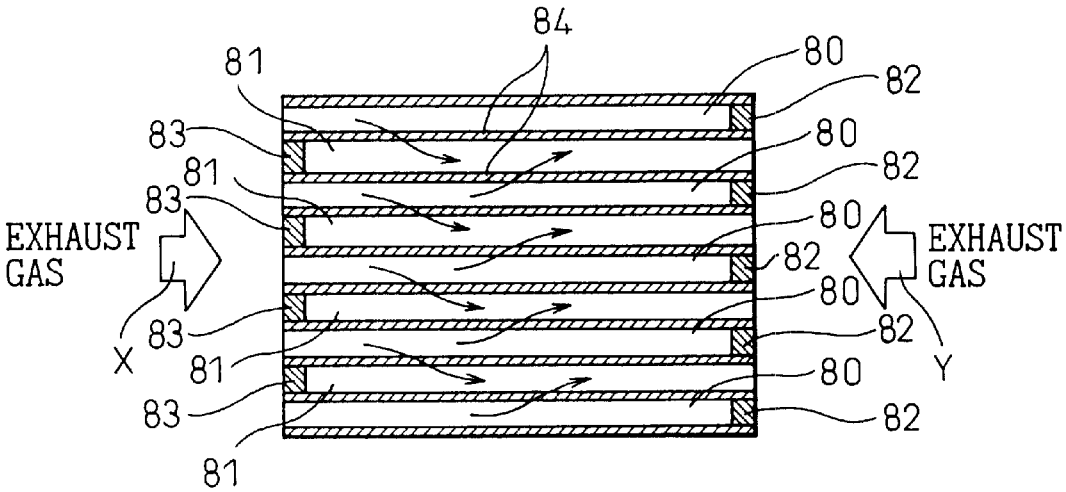

FIG. 6A is a front view of a representative particulate filter, while FIG. 6B is a side sectional view of the particulate filter shown in FIG. 6A. The particulate filters 66 shown in FIGS. 3A to 3F are elliptical in sectional shape. Further, while shorter in axial length than the particulate filter shown in FIGS. 6A and 6B, they have basically the same structure as the particulate filter shown in FIGS. 6A and 6B. The particulate filters 66 shown in FIGS. 4A to 4F are longer in the axial direction than the particulate filter shown in FIGS.

6A and 6B, but again have basically the same structures as the particulate filter shown in FIGS. 6A and 6B. Further, the particulate filters 66 shown in FIGS. 5A to 5F have substantially the same shapes as the particulate filter shown in FIGS. 6A and 6B. Therefore, instead of individually explaining the particulate filters 66 shown in FIG. 3A to FIG. 5F, an explanation will be given of the structure of the representative particulate filter shown in FIGS. 6A and 6B.

As shown in FIGS. 6A and 6B, the particulate filter forms a honeycomb structure and is provided with a plurality of exhaust circulation passages 80 and 81 extending in parallel with each other. These exhaust circulation passages are comprised by exhaust gas passages 80 with one ends sealed by plugs 82 and exhaust gas passages 81 with other ends sealed by plugs 83. Note that the hatched portions in FIG. 6A show plugs 83. Therefore, the exhaust gas passages 80 and the exhaust gas passages 81 are arranged alternately through thin wall partitions 84. In other words, the exhaust gas passages 80 and the exhaust gas passages 81 are arranged so that each exhaust gas passage 80 is surrounded by four exhaust gas passages 81, and each exhaust gas passage 81 is surrounded by four exhaust gas passages 80.

The particulate filter is formed from a porous material such as for example cordierite. Therefore, when exhaust gas is sent into the particulate filter from the X-direction in FIG. 6B, the exhaust gas flowing into the exhaust gas passages 80 flows out into the adjoining exhaust gas passages 81 through the surrounding partitions 84 as shown by the arrows. As opposed to this, in FIG. 6B, when exhaust gas is sent from the arrow Y direction inside the particulate filter, the exhaust gas flowing into the exhaust gas passage pipe 81 flows out into the adjoining exhaust gas passage pipe 80 through the peripheral partition wall 84 in the opposite direction to the arrow mark shown in FIG. 6B.

In this embodiment of the present invention, a layer of a carrier comprised of for example aluminum is formed on the peripheral surfaces of the exhaust gas passages 80 and 81, that is, the two side surfaces of the partitions 84 and the inside walls of the pores in the partitions 84. On the carrier are carried a precious metal catalyst and an active oxygen release agent which absorbs the oxygen and holds the oxygen if excess oxygen is present in the surroundings and releases the held oxygen in the form of active oxygen if the concentration of the oxygen in the surroundings falls.

In this case, in this embodiment according to the present invention, platinum Pt is used as the precious metal catalyst. As the active oxygen release agent, use is made of at least one of an alkali metal such as potassium K, sodium Na, lithium Li, cesium Cs, and rubidium Rb, an alkali earth metal such as barium Ba, calcium Ca, and strontium Sr, a rare earth such as lanthanum La, yttrium Y, and cerium Ce, and a transition metal such as tin Sn and iron Fe.

Note that in this case, as the active oxygen release agent, use is preferably made of an alkali metal or an alkali earth metal with a higher tendency of ionization than calcium Ca, that is, potassium K, lithium Li, cesium Cs, rubidium Rb, barium Ba, and strontium Sr or use is made of cerium Ce.

Next, the action of removal of the particulate in the exhaust gas by the particulate filter 66 shown in FIGS. 3A to 5F will be explained taking as an example the case of carrying platinum Pt and potassium K on a carrier, but the same type of action for removal of particulate is performed even when using another precious metal, alkali metal, alkali earth metal, rare earth, and transition metal.

In a compression ignition type internal combustion engine such as shown in FIG. 1, combustion occurs even under an excess of air. Therefore, the exhaust gas contains a large amount of excess air. That is, if the ratio of the air and fuel fed into the intake passage, combustion chamber 5, and exhaust passage is called the air-fuel ratio of the exhaust gas, then in a compression ignition type internal combustion engine such as shown in FIG. 1, the air-fuel ratio of the exhaust gas becomes lean. Further, in the combustion chamber 5, NO is generated, so the exhaust gas contains NO. Further, the fuel contains sulfur S. This sulfur S reacts with the oxygen in the combustion chamber 5 to become $SO_2$. Therefore, the fuel contains $SO_2$. Accordingly, when exhaust gas is fed into the particulate filter 66, exhaust gas containing excess oxygen, NO, and $SO_2$ flows into the exhaust gas passages 80 or 81.

Figure 7A:
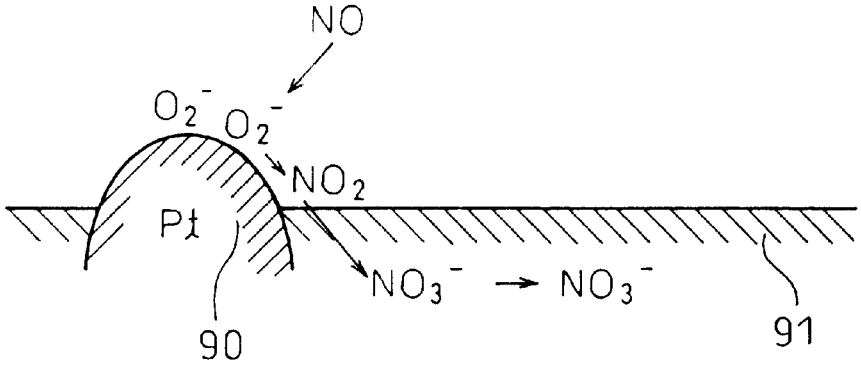
FIGS. 7A and 7B are views for explaining an oxidation action of particulate.
Figure 7B:
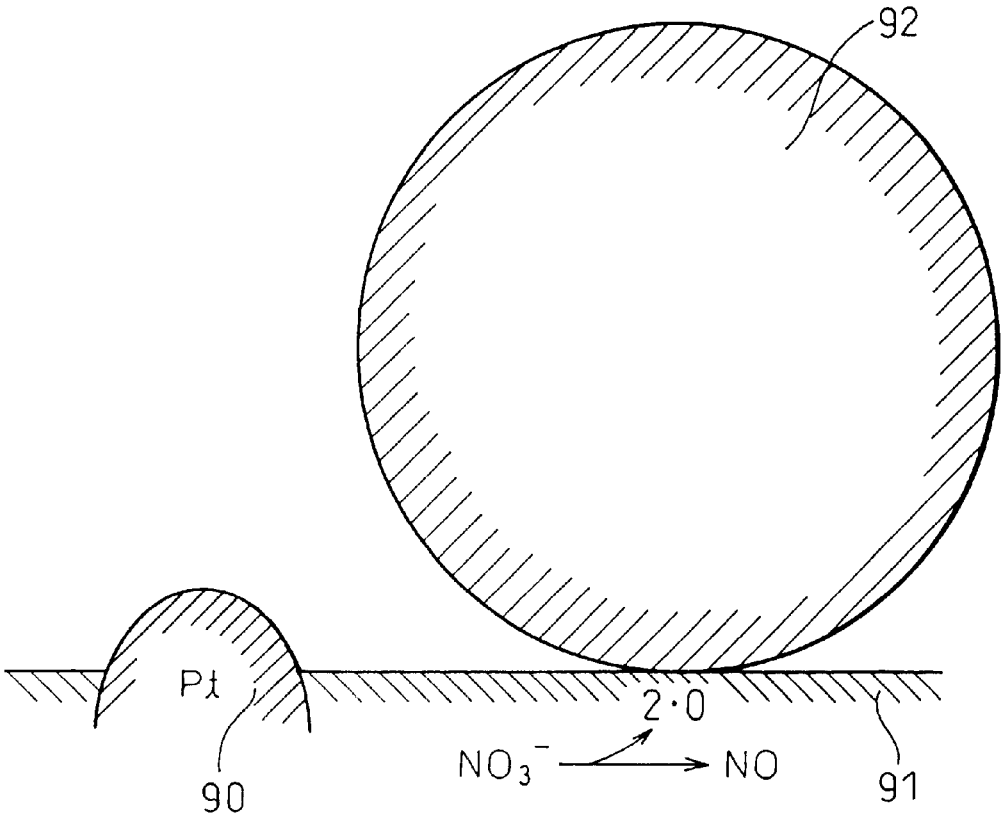

FIGS. 7A and 7B are enlarged views of the surface of the carrier layer formed on the inner peripheral surfaces of the exhaust gas passages 80 or 81 and the inside walls of the pores in the partitions 84. Note that in FIGS. 7A and 7B, 90 indicates particles of platinum Pt, while 91 indicates the active oxygen release agent containing potassium K.

In this way, since a large amount of excess oxygen is contained in the exhaust gas, if the exhaust gas flows into the exhaust gas passages 80 or 81 of the particulate filter 66, as shown in FIG. 7A, the oxygen $O_2$ adheres to the surface of the platinum Pt in the form of $O_2^-$ or $O_2^-$. On the other hand, the NO in the exhaust gas reacts with the $O_2^-$ or $O_2^-$ on the surface of the platinum Pt to become $NO_2$ ($2NO+O_2 \rightarrow 2NO_2$). Next, part of the $NO_2$ which is produced is absorbed in the active oxygen release agent 91 while being oxidized on the platinum Pt and diffuses in the active oxygen release agent 91 in the form of nitrate ions $NO_3^-$ as shown in FIG. 7A. Part of the nitrate ions $NO_3^-$ produces potassium nitrate $KNO_3$.

On the other hand, as explained above, the exhaust gas also contains $SO_2$. This $SO_2$ is absorbed in the active oxygen release agent 91 by a mechanism similar to that of NO. That is, in the above way, the oxygen $O_2$ adheres to the surface of the platinum Pt in the form of $O_2^-$ or $O_2^-$. The $SO_2$ in the exhaust gas reacts with the $O_2^-$ or $O_2^-$ on the surface of the platinum Pt to become $SO_3$. Next, part of the $SO_3$ which is produced is absorbed in the active oxygen release agent 91 while being oxidized on the platinum Pt and diffuses in the active oxygen release agent 91 in the form of sulfate ions $SO_4^{2-}$ while bonding with the potassium Pt to produce potassium sulfate $K_2SO_4$. In this way, potassium nitrate $KNO_3$ and potassium sulfate $K_2SO_4$ are produced in the active oxygen release agent 91.

On the other hand, particulate comprised of mainly carbon is produced in the combustion chamber 5. Therefore, the exhaust gas contains this particulate. The particulate contained in the exhaust gas contacts and adheres to the surface of the carrier layer, for example, the surface of the active oxygen release agent 91, as shown in FIG. 7B when the exhaust gas is flowing through the exhaust gas passages 80 or 81 of the particulate filter 66 or when flowing through the partitions 84.

If the particulate 92 adheres to the surface of the active oxygen release agent 91 in this way, the concentration of oxygen at the contact surface of the particulate 92 and the active oxygen release agent 91 falls. If the concentration of oxygen falls, a difference in concentration occurs with the inside of the high oxygen concentration active oxygen release agent 91 and therefore the oxygen in the active oxygen release agent 91 moves toward the contact surface between the particulate 92 and the active oxygen release agent 91. As a result, the potassium nitrate $KNO_3$ formed in the active oxygen release agent 91 is broken down into potassium K, oxygen O, and NO. The oxygen O heads toward the contact surface between the particulate 92 and the active oxygen release agent 91, while the NO is released from the active oxygen release agent 91 to the outside. The NO released to the outside is oxidized on the downstream side platinum Pt and is again absorbed in the active oxygen release agent 91.

On the other hand, at this time, the potassium sulfate $K_2SO_4$ formed in the active oxygen release agent 91 is also broken down into potassium K, oxygen O, and $SO_2$. The oxygen O heads toward the contact surface between the particulate 92 and the active oxygen release agent 91, while the $SO_2$ is released from the active oxygen release agent 91 to the outside. The $SO_2$ released to the outside is oxidized on the downstream side platinum Pt and again absorbed in the active oxygen release agent 91.

On the other hand, the oxygen O heading toward the contact surface between the particulate 92 and the active oxygen release agent 91 is the oxygen broken down from compounds such as potassium nitrate $KNO_3$ or potassium sulfate $K_2SO_4$. The oxygen O broken down from these compounds has a high energy and has an extremely high activity. Therefore, the oxygen heading toward the contact surface between the particulate 92 and the active oxygen release agent 91 becomes active oxygen O. If this active oxygen O contacts the particulate 92, the oxidation action of the particulate 92 is promoted and the particulate 92 is oxidized without emitting a luminous flame for a short period of several minutes to several tens of minutes. While the particulate 92 is being oxidized in this way, other particulate is successively depositing on the particulate filter 66. Therefore, in practice, a certain amount of particulate is always depositing on the particulate filter 66. Part of this depositing particulate is removed by oxidation. In this way, the particulate 92 deposited on the particulate filter 66 is continuously burned without emitting a luminous flame.

Note that the $NO_x$ is considered to diffuse in the active oxygen release agent 91 in the form of nitrate ions $NO_3$ while repeatedly bonding with and separating from the oxygen atoms. Active oxygen is produced during this time as well. The particulate 92 is also oxidized by this active oxygen. Further, the particulate 92 deposited on the particulate filter 66 is oxidized by the active oxygen O, but the particulate 92 is also oxidized by the oxygen in the exhaust gas.

When the particulate deposited in layers on the particulate filter 66 is burned, the particulate filter 66 becomes red hot and burns along with a flame. This burning along with a flame does not continue unless the temperature is high. Therefore, to continue burning along with such flame, the temperature of the particulate filter 66 must be maintained at a high temperature.

As opposed to this, in the present invention, the particulate 92 is oxidized without emitting a luminous flame as explained above. At this time, the surface of the particulate filter 66 does not become red hot. That is, in other words, in the present invention, the particulate 92 is removed by oxidation by a considerably low temperature. Accordingly, the action of removal of the particulate 92 by oxidation without emitting a luminous flame according to the present invention is completely different from the action of removal of particulate by burning accompanied with a flame.

The platinum Pt and the active oxygen release agent 91 become more active the higher the temperature of the particulate filter 66, so the amount of the active oxygen O able to be released by the active oxygen release agent 91 per unit time increases the higher the temperature of the particulate filter 66. Further, only naturally, the particulate is more easily removed by oxidation the higher the temperature of the particulate itself. Therefore, the amount of the particulate removable by oxidation per unit time without emitting a luminous flame on the particulate filter 66 increases the higher the temperature of the particulate filter 66.

Figure 9:
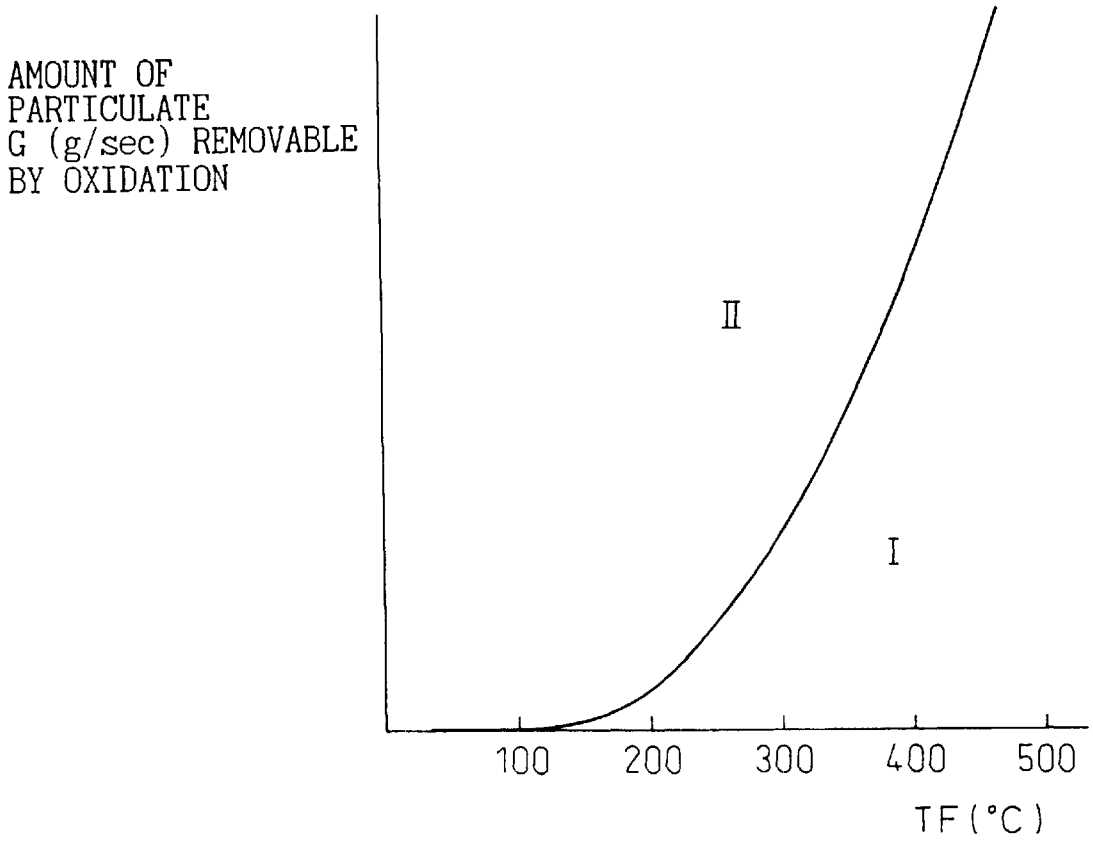
FIG. 9 is a view of the relation between the amount of particulate which can be oxidized and removed and the temperature of the particulate filter.

The solid line in FIG. 9 shows the amount G of the particulate removable by oxidation per unit time without emitting a luminous flame. The abscissa of FIG. 9 shows the temperature TF of the particulate filter 66. Note that FIG. 9 shows the amount G of particulate removable by oxidation in the case where the unit time is 1 second, that is, per second, but 1 minute, 10 minutes, or any other time may also be employed as the unit time. For example, when using 10 minutes as the unit time, the amount G of particulate removable by oxidation per unit time expresses the amount G of particulate removable by oxidation per 10 minutes. In this case as well, the amount G of particulate removable by oxidation per unit time without emitting a luminous flame on the particulate filter 66, as shown in FIG. 6, increases the higher the temperature of the particulate filter 66.

Now, if the amount of the particulate discharged from the combustion chamber 5 per unit time is called the amount M of discharged particulate, when the amount M of discharged particulate is smaller than the amount G of particulate removable by oxidation for the same unit time, for example, when the amount M of discharged particulate per 1 second is smaller than the amount G of particulate removable by oxidation per 1 second or when the amount M of discharged particulate per 10 minutes is smaller than the amount G of particulate removable by oxidation per 10 minutes, that is, in the region I of FIG. 9, all of the particulate discharged from the combustion chamber 5 is removed by oxidation successively in a short time without emitting a luminous flame on the particulate filter 66.

Figure 8A:
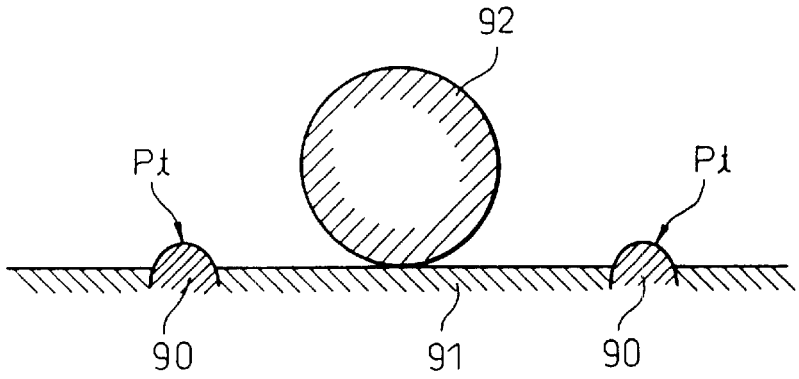
FIGS. 8A to 8C are view for explaining a deposition action of particulate.
Figure 8B:
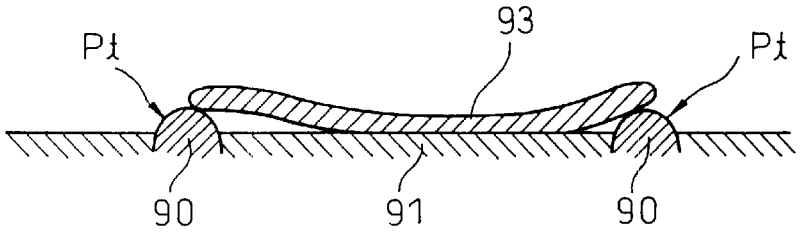
Figure 8C:
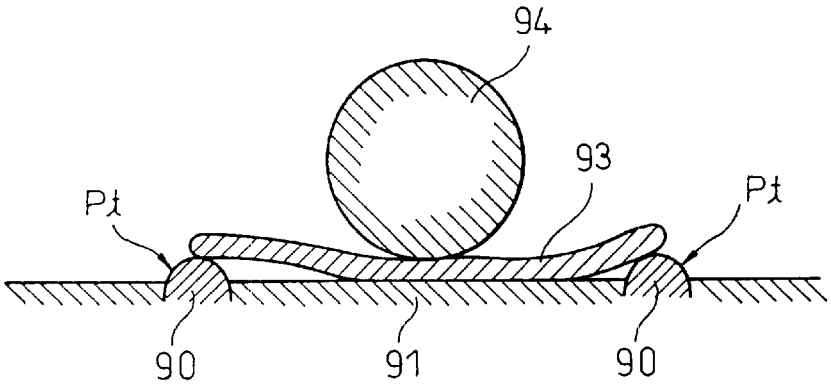

As opposed to this, when the amount M of discharged particulate is larger than the amount G of particulate removable by oxidation, that is, in the region II of FIG. 9, the amount of active oxygen is not sufficient for successive oxidation of all of the particulate. FIGS. 8A to 8C show the state of oxidation of particulate in this case.

That is, when the amount of active oxygen is not sufficient for successive oxidation of all of the particulate, if particulate 92 adheres on the active oxygen release agent 91 as shown in FIG. 8A, only part of the particulate 92 is oxidized. The portion of the particulate not sufficiently oxidized remains on the carrier layer. Next, if the state of insufficient amount of active oxygen continues, the portions of the particulate not oxidized successively are left on the carrier layer. As a result, as shown in FIG. 8B, the surface of the carrier layer is covered by the residual particulate portion 93.

This residual particulate portion 93 covering the surface of the carrier layer gradually changes to hard-to-oxidize graphite and therefore the residual particulate portion 93 easily remains as it is. Further, if the surface of the carrier layer is covered by the residual particulate portion 93, the action of oxidation of the NO and $SO_2$ by the platinum Pt and the action of release of the active oxygen from the active oxygen release agent 91 are suppressed. As a result, as shown in FIG. 8C, other particulate 94 successively deposits on the residual particulate portion 93. That is, the particulate deposits in layers. If the particulate deposits in layers in this way, the particulate is separated in distance from the platinum Pt or the active oxygen release agent 91, so even if easily oxidizable particulate, it will not be oxidized by active oxygen O. Therefore, other particulate successively deposits on the particulate 94. That is, if the state of the amount M of discharged particulate being larger than the amount G of particulate removable by oxidation continues, particulate deposits in layers on the particulate filter 66 and therefore unless the temperature of the exhaust gas is made higher or the temperature of the particulate filter 66 is made higher, it is no longer possible to cause the deposited particulate to ignite and burn.

In this way, in the region I of FIG. 9, the particulate is burned in a short time without emitting a luminous flame on the particulate filter 66. In the region II of FIG. 9, the particulate deposits in layers on the particulate filter 66. Therefore, to prevent the particulate from depositing in layers on the particulate filter 66, the amount M of discharged particulate has to be kept smaller than the amount G of the particulate removable by oxidation at all times.

As will be understood from FIG. 9, with the particulate filter 66 used in this embodiment of the present invention, the particulate can be oxidized even if the temperature TF of the particulate filter 66 is considerably low. Therefore, in a compression ignition type internal combustion engine shown in FIG. 1, it is possible to maintain the amount M of the discharged particulate and the temperature TF of the particulate filter 66 so that the amount M of discharged particulate normally becomes smaller than the amount G of the particulate removable by oxidation. Therefore, in this embodiment of the present invention, the amount M of discharged particulate and the temperature TF of the particulate filter 66 are maintained so that the amount M of discharged particulate usually becomes smaller than the amount G of the particulate removable by oxidation.

If the amount M of discharged particulate is maintained to be usually smaller than the amount G of particulate removable by oxidation in this way, the particulate no longer deposits in layers on the particulate filter 66. As a result, the pressure loss of the flow of exhaust gas in the particulate filter 66 is maintained at a substantially constant minimum pressure loss to the extent of being able to be said to not change much at all. Therefore, it is possible to maintain the drop in output of the engine at a minimum.

Further, the action of removal of particulate by oxidation of the particulate takes place even at a considerably low temperature. Therefore, the temperature of the particulate filter 66 does not rise that much at all and consequently there is almost no risk of deterioration of the particulate filter 66. Further, since the particulate does not deposit in layers on the particulate filter 66, there is no danger of coagulation of ash and therefore there is less danger of the particulate filter 66 clogging.

This clogging however occurs mainly due to the calcium sulfate $CaSO_4$. That is, fuel or lubrication oil contains calcium Ca. Therefore, the exhaust gas contains calcium Ca. This calcium Ca produces calcium sulfate $CaSO_4$ in the presence of $SO_3$. This calcium sulfate $CaSO_4$ is a solid and will not break down by heat even at a high temperature. Therefore, if calcium sulfate $CaSO_4$ is produced and the pores of the particulate filter 66 are clogged by this calcium sulfate $CaSO_4$, clogging occurs.

In this case, however, if an alkali metal or an alkali earth metal having a higher tendency toward ionization than calcium Ca, for example potassium K, is used as the active oxygen release agent 91, the $SO_3$ diffused in the active oxygen release agent 91 bonds with the potassium K to form potassium sulfate $K_2SO_4$. The calcium Ca passes through the partitions 84 of the particulate filter 66 and flows out into the exhaust gas passages 80 or 81 without bonding with the $SO_3$. Therefore, there is no longer any clogging of pores of the particulate filter 66. Accordingly, as described above, it is preferable to use an alkali metal or an alkali earth metal having a higher tendency toward ionization than calcium Ca, that is, potassium K, lithium Li, cesium Cs, rubidium Rb, barium Ba, and strontium Sr, as the active oxygen release agent 91.

Now, in this embodiment of the present invention, the intention is basically to maintain the amount M of the discharged particulate smaller than the amount G of the particulate removable by oxidation in all operating states. In practice, however, it is almost impossible to keep the amount M of discharged particulate lower than the amount G of the particulate removable by oxidation in all operating states. Therefore, in this embodiment of the present invention, the direction of flow of the exhaust gas through the particulate filter 66 is occasionally reversed by the flow path switching valve 57.

That is, for example, in FIG. 6B, the exhaust gas flows in the direction of the arrow mark X. At this time, it is assumed that the particulate deposits on the inner wall surface of the exhaust gas passage pipe 80. At this time, particulate does not deposit on the inner wall surface of the exhaust gas passage 81, so when the direction of flow of the exhaust gas reverses, that is, when the direction of flow of the exhaust gas switches to the direction of the arrow Y in FIG. 6B, the particulate in the exhaust gas can be removed well by oxidation on the inner wall surface of the exhaust gas passage 81. Further, since no particulate deposits on the inner wall surface of the exhaust gas passage 80, the already deposited particulate can be removed by oxidation. If the direction of flow of the exhaust gas reverses in this way, the particulate is removed by oxidation on the inner wall surface of the exhaust gas passage 81. Further, the deposited particulate is removed by oxidation on the inner wall surface of the exhaust gas passage 80. Therefore, by occasionally reversing the direction of flow of the exhaust gas, it becomes possible to continuously remove the particulate by oxidation.

Further, when for example the exhaust gas flows in the arrow X direction in FIG. 6B and the openings of the pores in the inner wall surface of the exhaust gas passage 80 are clogged by accumulations of particulate, the accumulations of the particulates are blown off the openings of the pores by the flow of exhaust gas. Due to this, there is the advantage that it is possible to prevent clogging of the pores.

Next, an explanation will be made of a routine for control of the flow path switching valve 57 with reference to FIG. 10.

Figure 10:
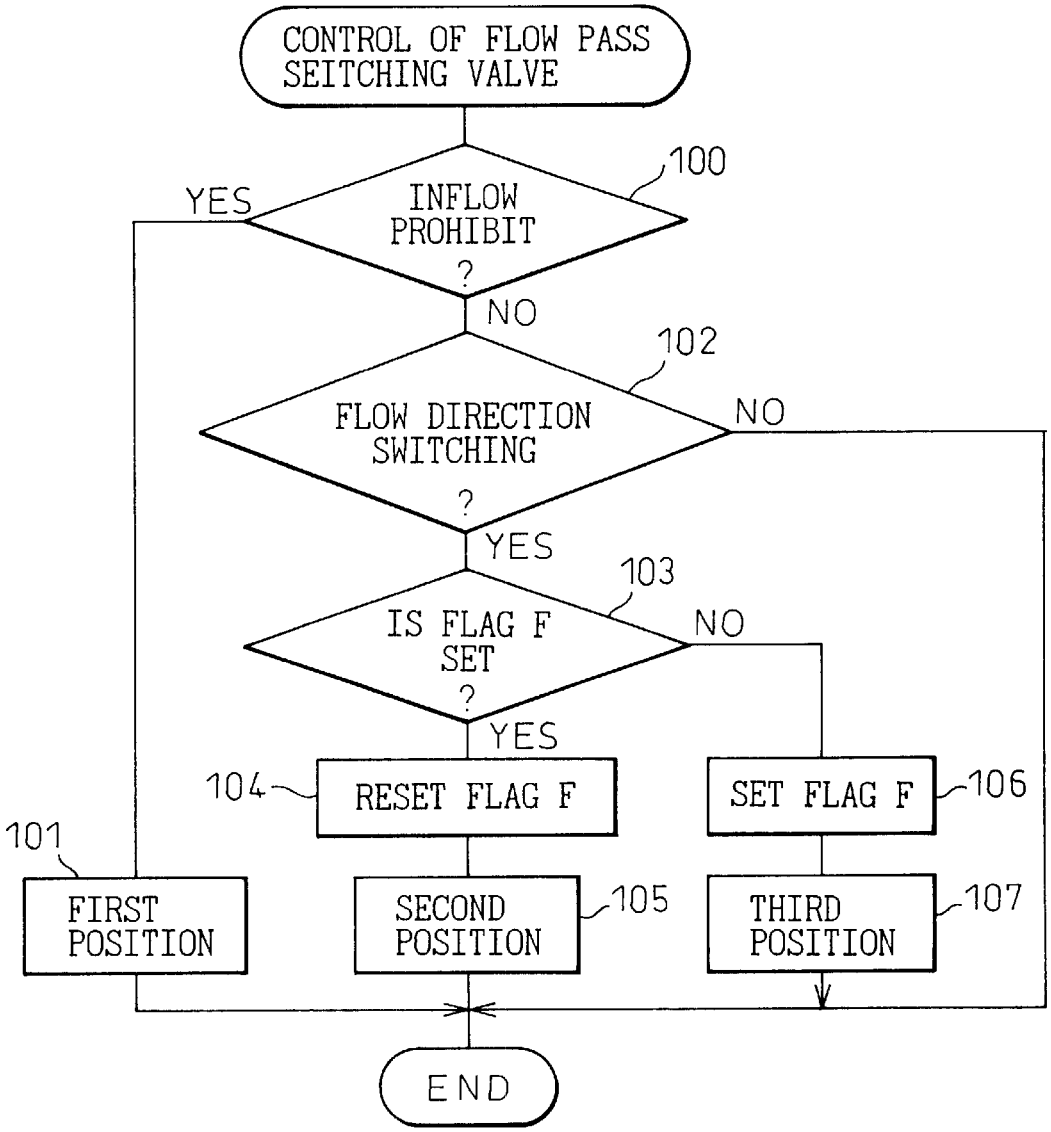
FIG. 10 is a flowchart of the control of the flow path switching valve.

Referring to FIG. 10, first, at step 100, it is judged if the flow of exhaust gas into the particulate filter 66 should be prohibited. When the temperature of the particulate filter 66 is low such as at the time of start of the engine, a large amount of particulate may deposit on the particulate filter 66. Further, in an operating state where the temperature of the exhaust gas becomes low, the temperature of the particulate filter 66 may fall and therefore at this time as well a large amount of particulate may deposit on the particulate filter 66. When there is a possibility of a large amount of particulate depositing on the particulate filter 66 in this way, it is judged that the flow of exhaust gas into the particulate filter 66 should be prohibited and the routine proceeds to step 101.

At step 101, the position of the flow path switching valve 57 is made the first position A shown in FIG. 2A. The exhaust gas flowing into the head portion 52 from the exhaust gas intake opening 53 at this time heads directly to the exhaust gas inflow opening 69 without going through the exhaust gas passage pipe 65 or the exhaust gas passages 64*f* and 64*g* and then flows into the first expansion chambers 64*a* and 64*e*. Therefore, at this time, a large amount of particulate will never deposit on the particulate filter 66.

On the other hand, when it is judged at step 100 that the inflow of exhaust gas to the particulate filter 66 should not be prohibited, the routine proceeds to step 102, where it is judged if the direction of flow of the exhaust gas to the particulate filter 66 should be switched. For example, when a certain time elapses after switching the direction of flow of the exhaust gas to the particulate filter 66 or when acceleration operation where a large amount of particulate is exhausted from the engine is completed, it is judged that the direction of flow of the exhaust gas to the particulate filter 66 should be switched. When it is judged that the direction of flow of the exhaust gas to the particulate filter 66 should be switched, the routine proceeds to step 103.

At step 103, it is judged if a flag F for switching the flow direction has been set. When the flag F has been set, the routine proceeds to step 104, where the flag F is reset. Next, at step 105, the position of the flow path switching valve 57 is switched to the second position B shown in FIG. 2A. The exhaust gas flowing from the exhaust gas intake opening 53 to the collecting portion 52 at this time heads toward the first exhaust gas outflow-inflow opening 67*a* , then flows inside the exhaust gas passage pipe 65 or exhaust gas passages 64*f* and 64*g* and the particulate filter 66. Next, the exhaust gas flowing out from the second exhaust gas outflow-inflow opening 67*b* heads toward the exhaust gas inflow opening 69 and then flows into the first expansion chambers 64*a* and 64*e*.

Next, when it is judged again at step 102 that the direction of flow of the exhaust gas to the particulate filter 66 should be switched, the flag F is reset, so the routine proceeds from step 103 to step 106 and the flag F is set. Next, at step 107, the position of the flow path switching valve 57 is switched to the third position C shown in FIG. 2A. At this time, the exhaust gas flowing from the exhaust gas intake opening 53 to the head portion 52 heads toward the second exhaust gas outflow-inflow opening 67*b*, then flows into the exhaust gas passage pipe 65 or the exhaust gas passages 64*f* and 64*g* and the particulate filter 66. Next, the exhaust gas flowing out from the first exhaust gas outflow-inflow opening 67*a* heads toward the exhaust gas inflow opening 69, then flows into the first expansion chambers 64*a* and 64*e*. In this way, the direction of flow of the exhaust gas to the particulate filter 66 is alternately switched.

Now, as explained above, the exhaust gas flows from the exhaust gas inflow opening 69 to the first expansion chambers 64*a* and 64*e* regardless of the flow path switching valve 57. If the exhaust gas flows into the first expansion chambers 64*a* and 64*e*, the exhaust pulsation attenuates and therefore the exhaust noise is reduced. Further, in the first embodiment shown in FIGS. 3A to 3F, the first expansion chamber 64*a* is communicated with the resonance chamber 64*c* through the communicating pipe 70, while in the second embodiment shown in FIGS. 4A to 4F, the first expansion chamber 64*a* is communicated with the resonance chamber 64*d* through the communicating pipe 70. The communicating pipe 70 and the resonance chambers 64*c* and 64*d* form Helmholtz resonators. Therefore, in the first expansion chamber 64*a*, the exhaust noise of a specific frequency determined by the diameter and length of the communicating pipe 70 and the volumes of the resonance chambers 64*c* and 64*d* is reduced.

Further, in the third embodiment shown in FIGS. 5A to 5F, the inside of the pipe 76 is communicated with the resonance chamber 64*a* through the communicating hole 77. The communicating hole 77 and the resonance chamber 64*a* form a Helmholtz resonator. Therefore, in the third embodiment, the exhaust noise of a specific frequency determined by the diameter and length of the communicating pipe 77 and the volume of the resonance chamber 64*a* is reduced. Note that the exhaust gas flowing inside the resonance chamber 64*a* flows out inside the first expansion chamber 64 through the exhaust gas outflow-inflow hole 78*a*.

Next, in the first embodiment shown in FIGS. 3A to 3F, the exhaust gas flows into the communicating pipe 70, then flows from the exhaust gas outflow holes 72 to the inside of the second expansion chamber 64*b*. At this time, since the exhaust pulsation is further attenuated, the exhaust noise can be further reduced. Next, the exhaust gas is exhausted through the exhaust pipe 71. On the other hand, in the second embodiment shown in FIGS. 4A to 4F, the exhaust gas flows into the communicating pipe 70, then flows from the exhaust gas outflow hole 72 to the second expansion chamber 64*c*. At this time, the exhaust pulsation is further attenuated, so the exhaust noise is further reduced. Further, in the second embodiment, the exhaust gas flowing into the second expansion chamber 64*c* flows from the exhaust gas outflow hole 73 formed on the partition wall 63*b* to the inside of the third expansion chamber 64*b*. At this time, the exhaust gas is further attenuated, so the exhaust noise can be further reduced. Next, the exhaust gas is exhausted through the exhaust pipe 71.

First, in the third embodiment shown in FIGS. 5A to 5F, the exhaust gas flows from the first expansion chamber 64*e* through the exhaust gas outflow-inflow holes 78 inside the second expansion chamber 64*b*. At this time, the exhaust noise can be further reduced since the exhaust pulsation is further reduced. Next, the exhaust gas is exhausted to the outside through the exhaust pipe 71. When communicating holes 79 are formed in the inner wall surface of the exhaust pipe 71 as shown in FIG. 5A, the exhaust noise of a specific frequency determined by the diameter and length of the communicating holes 79 and the volume of the resonance chamber 64*c* is reduced.

In the first embodiment shown in FIGS. 3A to 3F and in the second embodiment shown in FIGS. 4A to 4F, there is a clearance between the outer peripheral surface of the exhaust gas passage pipe 65 and the inner wall surface of the silencer body 60. Further, in the third embodiment shown in FIGS. 5A to 5F, there is a clearance between the cylindrical members 74*a* and 74*b* supporting the particulate filters 66 and the inner wall surface of the silencer body 60. Therefore, in all embodiments, the particulate filter 66 is in a state warmed with respect to the outside air. Further, high temperature exhaust gas passes around the particulate filter 66. Therefore, since it is possible to maintain the temperature of the particulate filter 66 at a high temperature, it becomes possible to remove by oxidation the particulate on the particulate filter 66 for a broad operating region.

On the other hand, the exhaust gas inflow opening 69, the first exhaust gas outflow-inflow opening 67*a*, and the second exhaust gas outflow-inflow opening 67*b* are arranged on one end of the silencer body 50, that is, the end wall 61 in the embodiment shown in FIG. 3A to FIG. 5F. Therefore, it is possible to easily connect the tubes 54, 55, and 56 of the flow path switching valve device 51 to the corresponding exhaust gas inflow opening 69, first exhaust gas outflow-inflow opening 67*a*, and second exhaust gas outflow-inflow opening 67*b*.

Further, when the flow path switching valve device 51 is made independent, that is, is formed separately from the silencer body 50, as in the embodiment shown in FIGS. 2A and 2B and FIGS. 3A to 5F, attachment of the flow path switching valve 57 and attachment of the actuator 59 to the flow path switching valve device 51 become extremely easy. Further, the flow path switching valve device 51 shown in FIGS. 2A and 2B has the advantage that it is possible to use it in common for the different silencer bodies 50 shown in FIG. 3A to FIG. 5F.

As explained above, however, in the embodiment shown in FIGS. 2A and 2B, the flow path switching valve 57 is controlled by the actuator 59 to one of a first position shown by the solid line A in FIG. 2A, a second position shown by the broken line B, and a third position shown by the broken line C. It is also possible to make part of the exhaust gas flowing from the exhaust gas intake opening 53 to the inside of the collecting portion 52 flow into the first exhaust gas outflow-inflow opening 67*a* and make the remaining exhaust gas directly flow into the exhaust gas outflow-inflow opening 69 by holding the flow path switching valve 57 at a position between the first position A and the second position B, make part of the exhaust gas flowing from the exhaust gas intake opening 53 to the collecting portion 52 flow into the second exhaust gas outflow-inflow opening 67*b*, and make the remaining exhaust gas directly flow into the exhaust gas inflow opening 69 by holding the flow path switching valve 57 at a position between the first position A and the third position C.

Now, in the embodiments discussed up to here, a layer of a carrier comprised of for example alumina is formed on the two side surfaces of the partition walls 84 and the inner wall surfaces of the pores in the partition walls 84 of the particulate filter 66. A precious metal catalyst and active oxygen release agent are carried on the carrier. In this case, it is also possible to have the carrier carry an NOx absorbent which absorbs the $NO_x$ contained in the exhaust gas when the air-fuel ratio of the exhaust gas flowing into the particulate filter 66 on this carrier is lean and releases the $NO_x$ absorbed when the air-fuel ratio of the exhaust gas flowing into the particulate filter 66 becomes the stoichiometric air-fuel ratio or rich.

In this case, as explained above, platinum Pt is used as the precious metal. As the $NO_x$ absorbent, use is made of at least one of an alkali metal such as potassium K, sodium Na, lithium Li, cesium Cs, and rubidium Rb, an alkali earth metal such as barium Ba, calcium Ca, and strontium Sr, and a rare earth such as lanthanum La and yttrium Y. Note that as will be understood from a comparison with the metal comprising the above active oxygen release agent, the metals comprising the NOx absorbent and the metals comprising the active oxygen release agent match in large part.

In this case, it is possible to use different metals for the $NO_x$ absorbent and active oxygen release agent or possible to use the same metal. When using the same metal for the $NO_x$ absorbent and the active oxygen release agent, the functions of both the function of the $NO_x$ absorbent and the function of the active oxygen release agent described above are simultaneously achieved.

Next, an explanation will be made of the action of absorption and release of $NO_x$ taking as an example the case of use of potassium K as the $NO_x$ absorbent using platinum Pt as the precious metal catalyst.

First, when the $NO_x$ absorption action is studied, $NO_x$ is absorbed in the $NO_x$ absorbent by the same mechanism as the mechanism shown in FIG. 7A. In this case, however, in FIG. 7A, reference numeral 91 indicates an $NO_x$ absorbent.

That is, when the air-fuel ratio of the exhaust gas flowing into the particulate filter 66 is lean, since a large amount of excess oxygen is contained in the exhaust gas, if the exhaust gas flows into the exhaust gas passage 80 or 81 of the particulate filter 66, as shown in FIG. 7A, the oxygen $O_2$ adheres on the surface of the platinum Pt in the form of $O_2^-$ or $O_2^-$. On the other hand, the NO in the exhaust gas reacts with the $O_2^-$ or $O^{2-}$ on the surface of the platinum Pt and becomes $NO_2$ ($2NO+O_2 \rightarrow 2NO_2$). Next, part of the $NO_2$ produced is absorbed in the $NO_x$ absorbent 91 while being oxidized on the platinum Pt and diffuses in the $NO_x$ absorbent 91 in the form of nitrate ions $NO_3^-$ as shown in FIG. 7A while bonding with the potassium K. Part of the nitrate ions $NO_3^-$ produces potassium nitrate $KNO_3$. In this way, NO is absorbed in the $NO_x$ absorbent 91.

On the other hand, if the exhaust gas flowing into the particulate filter 66 becomes rich, the nitrate ions $NO_3^-$ break down into oxygen O and NO. The NO is successively released from the $NO_x$ absorbent 91. Therefore, if the air-fuel ratio of the exhaust gas flowing into the particulate filter 66 becomes rich, NO is released from the $NO_x$ absorbent 91 in a short time. Further, since the NO released is reduced, NO is never exhausted into the atmosphere.

Note that in this case, even if the air-fuel ratio of the exhaust gas flowing into the particulate filter 66 is made the stoichiometric air-fuel ratio, NO is released from the $NO_x$ absorbent 91. In this case, however, since the NO is released only gradually from the $NO_x$ absorbent 91, it takes a somewhat long time for all of the $NO_x$ absorbed in the $NO_x$ absorbent 91 to be released.

As explained above, however, it is possible to use different metals for the $NO_x$ absorbent and active oxygen release agent or possible to use the same metal for the $NO_x$ absorbent and the active oxygen release agent. When using the same metal for the $NO_x$ absorbent and the active oxygen release agent, as explained above, the functions of both the function of the $NO_x$ absorbent and the function of the active oxygen release agent described above are simultaneously achieved. An agent which simultaneously achieves both these functions is referred to below as an active oxygen release agent/$NO_x$ absorbent. In this case, reference numeral 91 in FIG. 7A shows the active oxygen release agent/$NO_x$ absorbent.

When using such an active oxygen release agent/$NO_x$ absorbent 91, when the air-fuel ratio of the exhaust gas flowing into the particulate filter 66 is lean, the NO contained in the exhaust gas is absorbed in the active oxygen release agent/$NO_x$ absorbent 91. When the particulate contained in the exhaust gas adheres to the active oxygen release agent/$NO_x$ absorbent 91, the particulate can be removed by oxidation in a short time by the active oxygen etc. released from the active oxygen release agent/$NO_x$ absorbent 91. Therefore, it is possible to prevent both the particulate and $NO_x$ in the exhaust gas from being exhausted into the atmosphere at this time.

On the other hand, if the air-fuel ratio of the exhaust gas flowing into the particulate filter 66 becomes rich, NO is released from the active oxygen release agent/$NO_x$ absorbent 91. This NO is reduced by the unburned HC and CO. Therefore, at this time, NO is never exhausted into the atmosphere. Further, even if particulate has deposited on the particulate filter 66, when the air-fuel ratio of the exhaust gas flowing into the particulate filter 66 is temporarily made rich, the particulate deposited on the particulate filter 66 can be oxidized without emitting a luminous flame. That is, if the air-fuel ratio of the exhaust gas is made rich, that is, if the concentration of oxygen in the exhaust gas is reduced, the active oxygen O is released all at once from the active oxygen release agent/$NO_x$ absorbent 91. The deposited particulate is removed by oxidation in a short time without emitting a luminous flame due to the active oxygen O released all at once.

On the other hand, if the air-fuel ratio is maintained lean, the surface of the platinum Pt is covered by oxygen and so-called oxygen toxicity of the platinum Pt occurs. If such oxygen toxicity occurs, the oxidation action on the $NO_x$ falls, so the efficiency of absorption of the $NO_x$ falls and therefore the amount of release of active oxygen from the active oxygen release agent/$NO_x$ absorbent 91 falls. If the air-fuel ratio is made rich, however, the oxygen on the surface of the platinum Pt is consumed, so the oxygen toxicity is relieved. Therefore, if the air-fuel ratio is switched from rich to lean, the action of oxidation on $NO_x$ is strengthened, so the $NO_x$ absorption efficiency becomes higher and therefore the amount of release of active oxygen from the active oxygen release agent/$NO_x$ absorbent 91 is increased.

Therefore, when the air-fuel ratio is maintained lean, if the air-fuel ratio is occasionally temporarily switched from lean to rich, the oxygen toxicity of the platinum Pt is relieved each time, so it is possible to increase the amount of release of active oxygen when the air-fuel ratio is lean and consequently possible to promote the oxidation action of the particulate on the particulate filter 66.

Further, cerium Ce has a function for taking in oxygen ($Ce_2O_3+\frac{1}{2}O_2 \rightarrow 2CeO_2$) when the air-fuel ratio is lean and releasing active oxygen ($2CeO_2 \rightarrow \frac{1}{2}O_2+Ce_2O_3$) when the air-fuel ratio is rich. Therefore, if using cerium Ce as the active oxygen release agent 91, if particulate adheres to the particulate filter 66, when the air-fuel ratio is lean, the particulate is oxidized by the active oxygen released from the active oxygen release agent 9, while when the air-fuel ratio becomes rich, a large amount of active oxygen is released from the active oxygen release agent 91, so the particulate is oxidized. Therefore, even when using cerium Ce as the active oxygen release agent 91, if the air-fuel ratio is switched temporarily from lean to rich occasionally, it is possible to promote the oxidation reaction of the particulate on the particulate filter 66.

Note that when an $NO_x$ absorbent or active oxygen release agent/$NO_x$ absorbent is used, to release the $NO_x$ from the $NO_x$ absorbent or active oxygen release agent/$NO_x$ absorbent before the $NO_x$ absorption ability of the $NO_x$ absorbent or active oxygen release agent/NOx absorbent becomes saturated, the air-fuel ratio of the exhaust gas flowing into the particulate filter 66 is made temporarily rich.

Further, the present invention can also be applied to the case of carrying only a precious metal such as platinum Pt on the layer of the carrier formed on the two sides of the particulate filter 66. In this case, however, the solid line showing the amount G of the particulate which can be removed by oxidation moves somewhat to the right compared with the solid line shown by FIG. 9. In this case, active oxygen is released from $NO_2$ or $SO_3$ held on the surface of the platinum Pt.

Further, it is possible to use as an active oxygen release agent a catalyst which can adsorb and hold the $NO_2$ or $SO_3$ and release the active oxygen from the absorbed $NO_2$ or $SO_3$.

Note that the present invention can also be applied to an exhaust gas purification apparatus designed to arrange an oxidation catalyst in the exhaust passage upstream of the particulate filter, for example, in the exhaust pipe 22, convert the NO in the exhaust gas to $NO_2$ by this oxidation catalyst, and cause the $NO_2$ and the particulate deposited on the particulate filter to react to thereby use this $NO_2$ to oxidize the particulate.

According to the present invention, as explained above, it is possible to continuously remove the particulate in the exhaust gas by oxidation on the particulate filter.

While the invention has been described with reference to specific embodiment chosen for purpose of illustration, it should be apparent that numerous modifications could be made thereto by those skilled in the art without departing from the basic concept and scope of the invention.

What is claimed is:

1. An exhaust gas purification apparatus of an internal combustion engine comprising:

a silencer body having an end portion and an exhaust gas inflow opening through which an exhaust gas is introduced into an interior of the silencer body;

an exhaust gas flow passage having opposing ends and a passage portion extending within the interior of the silencer body, a first exhaust gas inflow-outflow opening being formed at one of said opposing ends of the exhaust gas flow passage, a second exhaust gas inflow-outflow opening being formed at the other of said opposing ends of the exhaust gas flow passage, all of said exhaust gas inflow opening, said first exhaust gas inflow-outflow opening, and said second exhaust gas inflow-outflow opening being arranged in said end portion of the silencer body;

a particulate filter arranged in said passage portion of the exhaust gas flow passage; and a flow path switching valve device arranged in said end portion of the silencer body for causing an exhaust gas, discharged from the engine and directed to the silencer body, to selectively flow into said exhaust gas inflow opening, said first exhaust gas inflow-outflow opening, and said second exhaust gas inflow-outflow opening.

2. An exhaust gas purification apparatus of an internal combustion engine as set forth in claim 1, wherein an entirety of the passage portion of the exhaust gas flow passage, in which the particulate filter is arranged, is arranged at a distance from an inner wall surface of the silencer body and wherein an exhaust gas flowing into the silencer body passes between the passage portion of the exhaust gas flow passage and the inner wall surface of the silencer body.

3. An exhaust gas purification apparatus of an internal combustion engine as set forth in claim 1, wherein the first exhaust gas inflow-outflow opening and the second exhaust gas inflow-outflow opening are connected by an exhaust gas passage pipe and wherein said exhaust gas flow passage is formed inside said exhaust gas passage pipe.

4. An exhaust gas purification apparatus of an internal combustion engine as set forth in claim 1, wherein the interior of the silencer body is divided into a plurality of subchambers forming expansion chambers or resonance chambers and wherein said exhaust gas inflow opening opens inside a subchamber formed at one end of the silencer body.

5. An exhaust gas purification apparatus of an internal combustion engine as set forth in claim 1, wherein as the particulate filter, use is made of a particulate filter which oxidizes and removes the particulate in the exhaust gas without emitting a luminous flame when it flows into the particulate filter when the amount of emitted particulate exhausted from the combustion chamber per unit time is less than the amount of particulate which can be oxidized and removed without emitting a luminous flame per unit time on the particulate filter and wherein an NOx absorbent which absorbs the NOx in the exhaust gas when the air-fuel ratio of the exhaust gas flowing into the particulate filter is lean and which releases the absorbed NOx when the air-fuel ratio of the inflowing exhaust gas becomes the stoichiometric air-fuel ratio or rich is carried on the particulate filter.

6. An exhaust gas purification apparatus of an internal combustion engine as set forth in claim 1, wherein the flow path switching valve device causes the exhaust gas to selectively flow into at least one of the exhaust gas inflow opening, the first exhaust gas inflow-outflow opening, and said second exhaust gas inflow-outflow opening.

7. An exhaust gas purification apparatus of an internal combustion engine as set forth in claim 1, wherein said flow path switching valve device is comprised of a manifold comprised of a collecting portion, an exhaust gas intake opening for the intake of exhaust gas exhausted from the engine into the collecting portion, and tubes branched off from the collecting portion and connected to the exhaust gas inflow opening, the first exhaust gas inflow-outflow opening and said second exhaust gas inflow-outflow opening and wherein a flow path switching valve is arranged in said collecting portion.

8. An exhaust gas purification apparatus of an internal combustion engine as set forth in claim 7, wherein said flow path switching valve is controlled to one position among a first position where the exhaust gas flowing from the exhaust gas intake opening is directed directly to the exhaust gas inflow opening without bypassing the exhaust gas flow passage, a second position where the exhaust gas flowing from the exhaust gas intake opening is directed to the first exhaust gas inflow-outflow opening and the exhaust gas flowing out from the second exhaust gas inflow-outflow opening is directed to the exhaust gas inflow opening, and a third position where the exhaust gas flowing from the exhaust gas intake opening is directed to the second exhaust gas inflow-outflow opening and the exhaust gas flowing out from the first exhaust gas inflow-outflow opening is directed toward the exhaust gas inflow opening.

9. An exhaust gas purification apparatus of an internal combustion engine as set forth in claim 1, wherein as the particulate filter, use is made of a particulate filter which removes the particulate in the exhaust gas by oxidation without emitting a luminous flame when it flows into the particulate filter when the amount of emitted particulate exhausted from the combustion chamber per unit time is less than the amount of particulate which can be oxidized and removed without emitting a luminous flame per unit time on the particulate filter and wherein a precious metal catalyst is carried on the particulate filter.

10. An exhaust gas purification apparatus of an internal combustion engine as set forth in claim 9, wherein an active oxygen release agent, taking in oxygen and holding that oxygen when there is excess oxygen in the surroundings and releasing the held oxygen when the concentration of oxygen in the surroundings in the form of active oxygen, is carried on the particulate filter and wherein the active oxygen is released from the active oxygen release agent when the particulate deposits on the particulate filter and the particulate deposited on the particulate filter is oxidized by the released active oxygen.

11. An exhaust gas purification apparatus of an internal combustion engine as set forth in claim 10, wherein said active oxygen release agent has a function of absorbing the NOx in the exhaust gas when the air-fuel ratio of the exhaust gas flowing into the particulate filter is lean and releasing the absorbed NOx when the air-fuel ratio of the exhaust gas flowing into the particulate filter becomes the stoichiometric air-fuel ratio or rich.

12. An exhaust gas purification apparatus of an internal combustion engine as set forth in claim 10, wherein said active oxygen release agent is comprised of at least one element selected from the group comprised of an alkali metal, alkali earth metal, rare earth, and transition metal.

13. An exhaust gas purification apparatus of an internal combustion engine as set forth in claim 12, wherein said alkali metal and alkali earth metal are comprised of metals having ionization tendencies higher than that of calcium.

* * * * *